US009266594B2

(12) United States Patent
Lindeborg

(10) Patent No.: US 9,266,594 B2
(45) Date of Patent: Feb. 23, 2016

(54) USE OF CENTER ENGINE FOR DOCKING

(75) Inventor: Mathias Lindeborg, Göteborg (SE)

(73) Assignee: CPAC SYSTEMS AB, V. Frölunda (SE)

( * ) Notice: Subject to any disclaimer, the term of this patent is extended or adjusted under 35 U.S.C. 154(b) by 0 days.

(21) Appl. No.: 14/378,295

(22) PCT Filed: Feb. 14, 2012

(86) PCT No.: PCT/SE2012/050155

§ 371 (c)(1),
(2), (4) Date: Sep. 26, 2014

(87) PCT Pub. No.: WO2013/122516

PCT Pub. Date: Aug. 22, 2013

(65) Prior Publication Data

US 2015/0127197 A1 May 7, 2015

(51) Int. Cl.

| | |
|---|---|
| ***B63H 25/00*** | (2006.01) |
| ***B63H 25/02*** | (2006.01) |
| ***B63H 20/12*** | (2006.01) |
| ***B63H 21/21*** | (2006.01) |
| *B63H 20/00* | (2006.01) |

(52) U.S. Cl.

CPC ..... *B63H 25/02* (2013.01); *B63H 20/00* (2013.01); *B63H 20/12* (2013.01); *B63H 21/21* (2013.01); *B63H 21/265* (2013.01); *B63H 2020/003* (2013.01)

(58) Field of Classification Search

CPC ..... B63H 25/02; B63H 20/12; B63H 21/21; B63H 25/42; B63H 23/08

See application file for complete search history.

(56) References Cited

U.S. PATENT DOCUMENTS

| | | | | |
|---|---|---|---|---|
| 6,234,853 | B1 * | 5/2001 | Lanyi et al. | 440/53 |
| 7,121,908 | B2 * | 10/2006 | Okuyama | 440/84 |
| 8,589,004 | B1 * | 11/2013 | Kanno | 701/21 |
| 8,807,059 | B1 * | 8/2014 | Samples et al. | 114/144 R |
| 2007/0093147 | A1 | 4/2007 | Mizutani | |

FOREIGN PATENT DOCUMENTS

| | | | |
|---|---|---|---|
| EP | 2210810 | A2 | 7/2010 |
| WO | 2007105995 | A1 | 9/2007 |

OTHER PUBLICATIONS

International Search Repoirt (Sep. 4, 2012) for corresponding International Application PCT/SE2012/050155.

Supp. European Search Report (Dec. 14, 2015) for corresponding European App. EP 12 86 8433.

* cited by examiner

*Primary Examiner* — Rodney Butler
(74) *Attorney, Agent, or Firm* — WRB-IP LLP

(57) ABSTRACT

In a marine propulsion control system for controlling a set of propulsion units carried by a hull of a vessel, cavitation typically occurs on the propulsion unit with reverse gear engaged, and in a triple propulsion unit installation the normally idle center propulsion unit can be used to increase the reverse thrust and thereby limit the RPM of propulsion units in reverse, so that the cavitation effect is limited, and simultaneously allow for higher forward thrust on the third propulsion unit, thus increasing the total thrust for the vessel.

11 Claims, 4 Drawing Sheets

USE OF CENTER ENGINE FOR DOCKING

BACKGROUND AND SUMMARY

The present invention relates to a control system for docking a marine vessel.

Today's marine vessels are often equipped with a plurality of propulsion units, for example three, for driving the vessel. If every propulsion unit is associated to a separate control lever the handling of the vessel can be unnecessarily complicated. As many users of marine vessels are not experienced helmspersons, a simplified control system is desirable.

WO 2007/105995 describes a control system for a set of propulsion units where a centrally arranged propulsion unit of the set is controlled as a slave based on control signals provided by at least one of the remaining propulsion units of the set. Thereby, the number of control levers are decreased, for example from three to two, thus the control system for the vessel is simplified.

However, there is always a desire to even further simplify the handling of a marine vessel, for example by means of introducing further improvements to the control system for controlling a set of marine propulsion units.

It is desirable to achieve a control system for a set of marine propulsion units and a marine vessel with such a control system that is further simplified.

The inventor has realized that the thrust that can be applied from each propulsion unit is limited due to the propeller cavitation effect, resulting in reduction of the total thrust generated on the vessel. The invention is based on the inventor's realization that the cavitation typically occurs on the propulsion unit with reverse gear engaged, and that in a triple propulsion unit installation the normally idle center propulsion unit can be used to increase the reverse thrust and thereby limit the RPM of propulsion units in reverse, so that the cavitation effect is limited, and simultaneously allow for higher forward thrust on the third propulsion unit, thus increasing the total thrust for the vessel.

According to a first aspect of the inventive concept, a marine propulsion control system for controlling a set of propulsion units carried by a hull of a vessel, wherein the set of propulsion units comprise a first propulsion unit, a second propulsion unit and a third propulsion unit, wherein the second propulsion unit is provided as a center propulsion unit between the first and third propulsion unit, the marine propulsion control system comprising a control unit configured to receive an input command from a steering control instrument for operating the vessel, determine a desired delivered thrust, gear selection and steering angle for the first, second and third propulsion unit respectively, based on the input command, and provide a set of control commands for controlling the desired delivered thrust, gear selection and steering angle for the first, second and third propulsion unit, wherein if the input command indicates a sway command the first propulsion unit is set to have a forward gear selection and the third propulsion unit is set to have a reverse gear selection, each with a selected thrust level, and if the thrust level for at least one of the first and the third propulsion unit exceeds a predetermined thrust level the second propulsion unit is set to have a reverse gear selection with a thrust level depending on the selected thrust level of at least one of the first and the third propulsion unit.

In the context of this application a vessel should interpreted as any type of vessel, such as larger commercial ships, smaller vessel such as leisure boats and other types of water vehicles or vessels.

Furthermore, in the context of this application "gear selection" should be interpreted as selection of rotation direction of the propeller, i.e. forwards or rearwards rotation direction.

Through the system described, the propulsion units can be controlled individually. Thereby the propulsion units may for example be switched independently between a forward propulsion state and a reverse propulsion state and steered independently of one another.

By allowing the second propulsion unit to assist the first or third propulsion unit in creating a reverse thrust on the vessel, the total thrust of the vessel can be increased with 80-100 percent. Thereby, an operator of the vessel has more thrust to control the vessel, thus allowing the operator to act later and with more effect which means facilitated handling of the vessel.

Many inexperienced operators compare operating a marine vessel to operating a land vehicle, e.g. a car, and one of the hardest things to learn is how the marine vessel drifts due to inertial effects, wind and currents, which require the operators to plan their movements long in advance. When increased thrust to control the vessel is provided, the operator can reduce the time-span of the vessel's planned movements. This is a great advantage for an inexperienced operator.

In one embodiment the steering angle of the second propulsion unit is substantially the same as the steering angle of the third propulsion unit.

The first propulsion unit can be either a starboard or a port propulsion unit. Consequently, the third propulsion unit can be either a port or a starboard propulsion unit. The vessel will sway in the same direction as the position of the propulsion unit that is set with a reverse gear selection relative a thought center line. Thus, if the first propulsion unit is a port propulsion unit and the first propulsion unit is set in a reverse gear selection, the vessel will sway in a port direction.

Preferably, the first and third propulsion units' steering angles are substantially inverted relative a longitudinal axis. In the context of this application a longitudinal axis should be interpreted as an axis extending from the vessel's bow to the vessel's stern.

In one embodiment of the invention the first and third propulsion unit angles are set to an outwards angle. Thereby a component force in the lateral axis achieving a sway movement of the vessel is provided.

In another embodiment the first and third propulsion unit angles are set to a substantially maximum outwards angle. Thereby, the component force in the lateral axis achieving a sway movement of the vessel may be substantially maximized.

Further, if the first and third propulsion units are substantially inverted relative the longitudinal axis, and their thrust level are substantially equal, the force component in a forward/reverse direction will be zero, thus only a sway movement of the vessel will be achieved.

According to another embodiment, the marine propulsion control system further comprises three independent Engine Control Unit for providing an interface between the control unit and the first, second and third propulsion unit respectively. Thereby, the control unit does not have to comprise an interface for communicating with each of the first, second and third propulsion unit. Moreover, existing ECUs in a marine vessel can be utilized. According to yet another embodiment of the inventive concept, the three independent ECUs are electrically connected to the control unit.

According to another embodiment, the predefined level of the thrust level for one of the first or third propulsion unit corresponds to a level less than where a reverse propulsion direction of the first or third propulsion unit causes cavitation.

Thereby, the cavitation effect typically occurring in the propulsion unit with a reverse gear selection can be alleviated through that the second propulsion unit assists the propulsion unit with a reverse gear selection by also creating a reversely directed thrust. By avoiding cavitation effects the total thrust of the vessel can be increased further.

According to yet another embodiment, the marine propulsion control system further comprises a steering control instrument for providing the control unit with an input command. Thereby, the operator can easily provide input commands to the control unit, so that the control unit can control the propulsion units in a direction desired by the operator.

Preferably, the inventive control system forms part of a marine vessel, further comprising a first propulsion unit, a second propulsion unit, a third propulsion unit, wherein the second propulsion unit is provided as a center propulsion unit between the first and second propulsion unit, each propulsion unit are carried by a hull.

By providing a vessel with a marine propulsion control system allowing the second propulsion unit to assist the first or third propulsion unit in creating a reverse thrust on the vessel, the total thrust of the vessel can be increased. Thereby, an operator of the vessel has more thrust to control the vessel, thus allowing the operator to act later and with more effect which implies facilitated handling of the vessel.

According to a second aspect of the present inventive concept, there is provided a method for controlling a set of propulsion units carried by a hull of a vessel, wherein the set of propulsion units comprise a first propulsion unit, a second propulsion unit and a third propulsion unit, wherein the second propulsion unit is provided as a center propulsion unit between the first and second propulsion unit, the method comprising receiving an input command from a steering control instrument operating the vessel, determining a desired delivered thrust, gear selection and steering angle for the first, second and third propulsion unit respectively, based on the input command, and providing a set of control commands for controlling the desired delivered thrust, gear selection and steering angle for the first, second and third propulsion unit, and setting the second propulsion unit to have a reverse gear selection with a thrust level if the input command indicates a sway command and the first propulsion unit is set to have a forward gear selection and the third propulsion unit is set to have a reverse gear selection, each with a thrust level, and if the thrust level for one of the first or the third propulsion unit exceeds a predetermined thrust level.

The effects of a method as described above are largely analogous to the effects of a marine propulsion control system and a vessel as described above. By providing a method for allowing the second propulsion unit to assist the first or third propulsion unit in creating a reverse thrust on the vessel, the total thrust of the vessel can be increased substantially. Thereby, an operator of the vessel has more thrust to control the vessel, thus allowing the operator to act later and with more effect which implies facilitated handling of the vessel.

According to another embodiment, the method further comprises providing the predefined thrust level for one of the first or the third propulsion unit so that it corresponds to a level less than where a reverse propulsion direction of the first or third propulsion unit causes cavitation. Thereby, the cavitation effect typically occurring in the propulsion unit with a reverse gear selection can be alleviated through that the second propulsion unit assists the propulsion unit with a reverse gear selection by also creating a reversely directed thrust. By avoiding cavitation effects the total thrust of the vessel can be increased further, which in turn means facilitated handling.

According to a third aspect of the present invention there is provided a computer program product comprising a computer readable medium having stored thereon computer program means for causing a control unit to control a set of propulsion units carried by a hull of a vessel, wherein said set of propulsion units comprise a first propulsion unit, a second propulsion unit and a third propulsion unit, wherein said second propulsion unit is provided as a center propulsion unit between said first and second propulsion unit, wherein the computer program product comprises code for receiving an input command from a steering control instrument operating the vessel, code for determining a desired delivered thrust, gear selection and steering angle for said first, second and third propulsion unit respectively, based on the input command, code for providing a set of control commands for controlling the desired delivered thrust, gear selection and steering angle for said first, second and third propulsion unit, and code for setting said second propulsion unit to have a reverse gear selection with a thrust level if said input command indicates a sway command and the first propulsion unit is set to have a forward gear selection and the third propulsion unit is set to have a reverse gear selection, each with a thrust level, and if the thrust level for one of said first or said third propulsion unit exceeds a predetermined thrust level.

The control unit is preferably a micro processor or similar device, and the computer readable medium may be one of a removable nonvolatile random access memory, a hard disk drive, a floppy disk, a CD-ROM, a DVD-ROM, a USB memory, an SD memory card, or a similar computer readable medium known in the art. The effects of a the computer product implementation of the invention for controlling a set of propulsion units by a control unit as described above are largely analogous to the effects of a marine propulsion control system, vessel and method as described above.

Furthermore, a code for controlling a set of marine propulsion units allows a user to upgrade an existing marine propulsion control system that allows separate individual control of the steering angle, thrust level and gear selection of the set or propulsion units. With abovementioned code, the upgrade could be done carried out with merely software alterations, vastly reducing the costs for a vessel owner to upgrade the marine propulsion control system.

BRIEF DESCRIPTION OF DRAWINGS

Embodiments of the invention will in the following be described in more detail with reference to the enclosed drawings, wherein.

DETAILED DESCRIPTION

Figure 1:
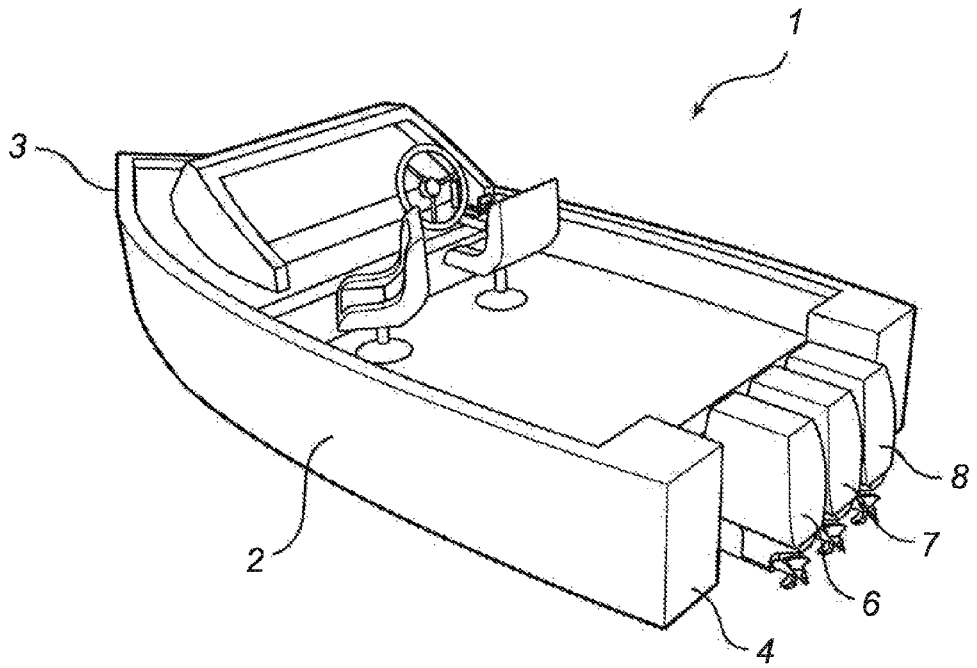
FIG. 1 schematically illustrates a perspective-view of a marine vessel comprising a marine propulsion control system configured to control three propulsion units.

The present invention will be described more fully hereinafter with reference to the accompanying drawings, in which preferred embodiments of the invention are shown. The inventive concept may, however, be embodied in many different forms and should not be construed as limited to the embodiments set forth herein; rather, these embodiments are provided so that this disclosure will be thorough and complete, and will fully convey the scope of the invention to those skilled in the art. In the drawings, like numbers refer to like elements.

In the description below a control system for a set of marine propulsion units wherein the input means is a joystick, is mainly discussed. It should however be noted that this by no means should limit the scope of the application which is equally applicable on a control system where the input means is a stick, a set of buttons, a touch screen or equivalent.

Moreover, a control system for a set of marine propulsion units comprising three propulsion units is mainly discussed. It should however be noted that this by no means should limit the scope of the application, which is equally applicable on a set of marine propulsion units comprising five, seven or any other odd numbers above two.

Furthermore, a control system for a set of marine propulsion units, comprising three Engine Control Units (ECU), is mainly discussed. It should however be noted that this by no means should limit the scope of the inventive concept, which is equally applicable on a control system where a control unit internally comprise the functionality of the ECU.

FIG. 1 shows a simplified top view of a marine vessel 1 in which the marine propulsion control system 9 according to an embodiment of the inventive concept can be used. Generally, the control system according to an embodiment of the inventive concept may be used in any type of vessel, such as larger commercial ships, smaller vessel such as leisure boats and other types of water vehicles or vessels. The invention is particularly useful for small leisure boats, but it is nevertheless not limited to such type of water vehicle only.

As further schematically illustrated in FIG. 1, the vessel 1 may be designed with a hull 2 having a bow 3, a stern 4 and being divided into two symmetrical portions by a thought centre line running from the bow 3 to the stern 4. In the stern 4, three propulsion units 6, 7 and 8 may be mounted. More precisely, the vessel 1 may be provided with a first propulsion unit 6 arranged at the port side, a second propulsion unit 7 arranged in the centre and a third propulsion unit 8 arranged at the starboard side. The propulsion units 6, 7 and 8 may be pivotally arranged in relation to the hull 2 for generating a driving thrust in a desired direction of a generally conventional kind. The propulsion units may alternatively be inboard propulsion units, mounted under the boat on the hull 2 or mounted on the stern 4 as so called sterndrives. That is, the propulsion units 6, 7 and 8 may be outboard propulsion units or inboard propulsion units.

Figure 2:
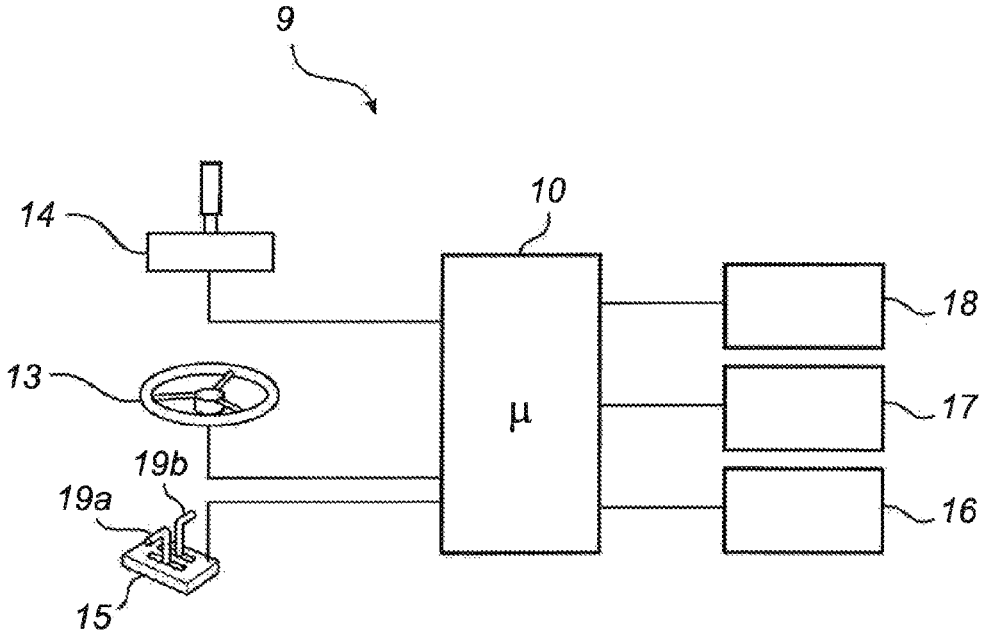
FIG. 2 illustrates a scheme of a control system for a set of marine propulsion units, FIG. 3*a* schematically illustrates a top-view of a marine vessel comprising a marine propulsion control system configured to control three propulsion units, FIG. 3*b* schematically illustrates a top-view of a marine vessel comprising a marine propulsion control system configured to control three propulsion units, FIG. 4 schematically illustrates a top-view of a marine vessel comprising a marine propulsion control system configured to control five propulsion units.

The control of the propulsion units are performed by a marine propulsion control system 9 as further illustrated in FIG. 2.

FIG. 2 is a scheme diagram showing the scheme of a marine propulsion control system 9 according to one embodiment. The control system includes a control unit 10, steering control instruments such as a joystick 14, a steering wheel 13 and/or a thrust regulator 15, and a first 16, second 17 and third 18 Engine Control Unit (ECU). The first 16, second 17 and third 18 ECU are adapted to control a first 6, second 7 and third 8 propulsion unit, respectively.

In one implementation, each propulsion unit 6, 7, 8 may include a gear selector, a steering actuator, and a steering angle detecting section. The gear selector may change gear selection for each propulsion unit between a forward propulsion position, a reverse propulsion position, and a neutral position. Alternatively, two gear selectors are provided. One for each group of propulsion units positioned on the starboard side of the thought centre line and one for the group of propulsion units positioned on the port side of the thought centre line.

The steering actuator may turn the propulsion unit about a steering axis and thereby altering the steering angle thrust direction. The steering actuator may include a hydraulic cylinder or an electrical motor. The steering angle detecting section may detect an actual steering angle propulsion unit. If the steering actuator is a hydraulic cylinder, then the steering angle detecting section may be a stroke sensor for the hydraulic cylinder. However, the steering angle detecting section may be any means for measuring or calculating the steering angle.

The control unit 10 contains means for mapping an input signal from the steering control instruments into a reference value angle for respective propulsion unit 6, 7, 8 where the steering actuators are arranged to move the propulsion units such that they assume the reference value angle. The mapping may be of simple type such that a steering angle is obtained from the steering control instruments and that the steering actuator uses this input command as the reference value angle. The mapping may also be more complex such that the reference value angles are calculated in dependence of the driving situation including speed, desired trim angle, whether docking is performed such that sway of the vessel is desired and so forth.

The ECUs may control operations of the associated propulsion units, through controlling the gear selection, delivered thrust and the steering angle. The controlled operations may be based on the input commands from the steering wheel 13, joystick 14 and thrust regulator 15. The ECUs may be connected to the control unit 10 through a communication line. In another embodiment, the ECU is capable of communicating with the control unit 10 wirelessly.

In another embodiment of the invention, the three mentioned ECUs form an integral part of the control unit 10.

Through the system described, the propulsion units 6, 7, 8 can be controlled individually. Thereby the propulsion units may be e.g. switched independently between a forward propulsion state and a reverse propulsion state and steered independently of one another.

The thrust regulator 15 comprises port throttle lever 19*a*, and a starboard throttle lever 19*b* arranged to generate a desired delivered thrust by the propulsion units contributing to the thrust on the port and starboard side respectively. When a throttle lever 19*a*, 19*b* is tilted forward/backwards a detection signal is transmitted to the control unit 10 comprising the desired gear selection, i.e. forward/backward, and a thrust level associated with the angle that the throttle lever 19*a*, 19*b* is tilted with relative a neutral position.

The port throttle lever 19*a* is primarily intended for the first propulsion unit and the starboard throttle lever 19*b* for the third propulsion unit. If the first 6 and third 8 propulsion units have the same gear selection, i.e. forward or backward, the second 7 propulsion unit will also have said same gear selection. However, if one of the first 6 and the third 8 propulsion unit is set to have a forward gear selection and the other of the first 6 and the third 8 propulsion unit is set to have a reverse gear selection, each with a selected thrust level, and if the thrust level for at least one of the first 6 and the third 8 propulsion unit exceeds a predetermined thrust level, then the second 7 propulsion unit is set to have a reverse gear selection with a thrust level depending on the selected thrust level of at least one of the first 6 and the third 8 propulsion unit.

Gear selectors and throttle lever units are previously known as such, and for this reason they are not described in detail here. Based on received information from the steering control instruments 13, 14, 15 the control unit 10 is arranged to control the propulsion units 6, 7, 8 in a suitable manner to propel the vessel 1 with a requested direction and thrust.

The joystick 14 may be adapted to primarily be used to control the vessel in low speed. The joystick 14 may supply the control unit 10 with input commands comprising any combinations of a translational movements, such as sway or surge, and yaw movements. Thus, a user may through the joystick 14 supply the control unit with an input command comprising e.g. port sway and clockwise yaw.

The joystick 14 may be tilted in at least four directions; forward, rearward, leftward, and rightward. Thus, the direction may be operated so as to issue input commands in at least forward or reverse surge, left or right sway movement of the vessel 1. Moreover, the joystick 14 may also be rotatable operated so as to issue an operating instruction for achieving a yaw movement of the vessel 1. In one embodiment this is accomplished by rotating the joystick about a central vertical axis. When the joystick is altered from its neutral position a detection signal is transmitted to the control unit 10.

For example, when an operator tilts the joystick to the port side and rotates it clockwise the propulsion units are controlled such that the hull 2 moves in a sway movement translational to the port side with a clockwise rotation. As described above, there are only four basic combinations of sway and yaw movements.

In one embodiment the control unit 10 comprises computing means such as a CPU or other processing device, and storing means such as a semiconductor storage section, e.g., a RAM or a ROM, or such a storage device as a hard disk or a flash memory. The storage section can store settings and programs or schemes for interpreting input commands and generation control commands for controlling the propulsion units.

The control unit 10 controls a forward/reverse propulsion direction, a desired thrust, i.e. propulsion force, and a desired steering angle of each of the propulsion units individually in accordance with input commands from the steering control instruments 13, 14, and 15.

The desired thrust of the propulsion units correspond to a target propulsion unit rotational speed. Thus, controlling the thrust often means controlling a propeller rotational speed.

In one implementation the thrust regulator 15 includes a single starboard input command and a single port input command for each function that is under control by the thrust regulator. As have been explained above, these functions may include port and starboard throttle levers and port and starboard gear selectors.

Figure 3A:
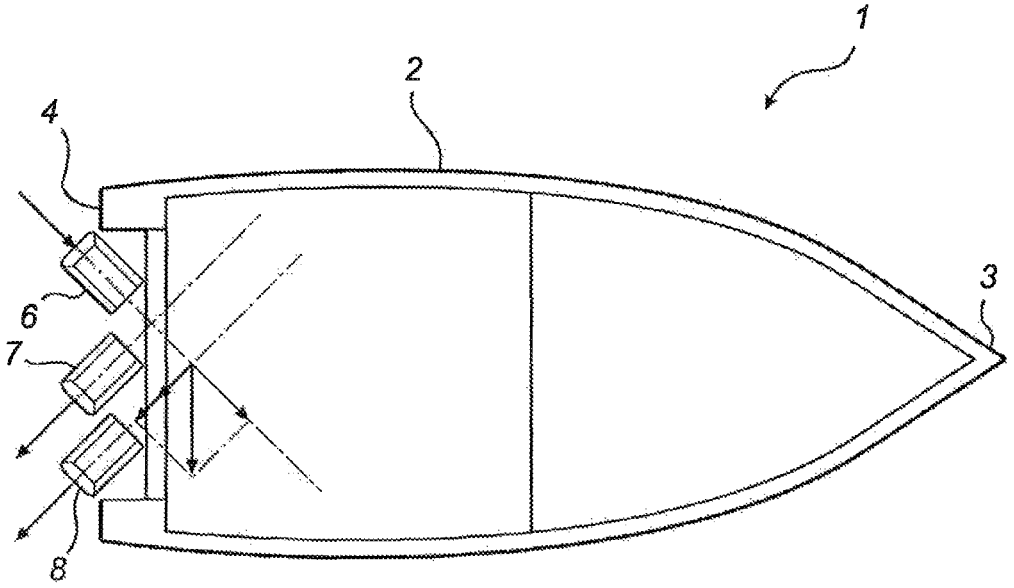
Figure 3B:
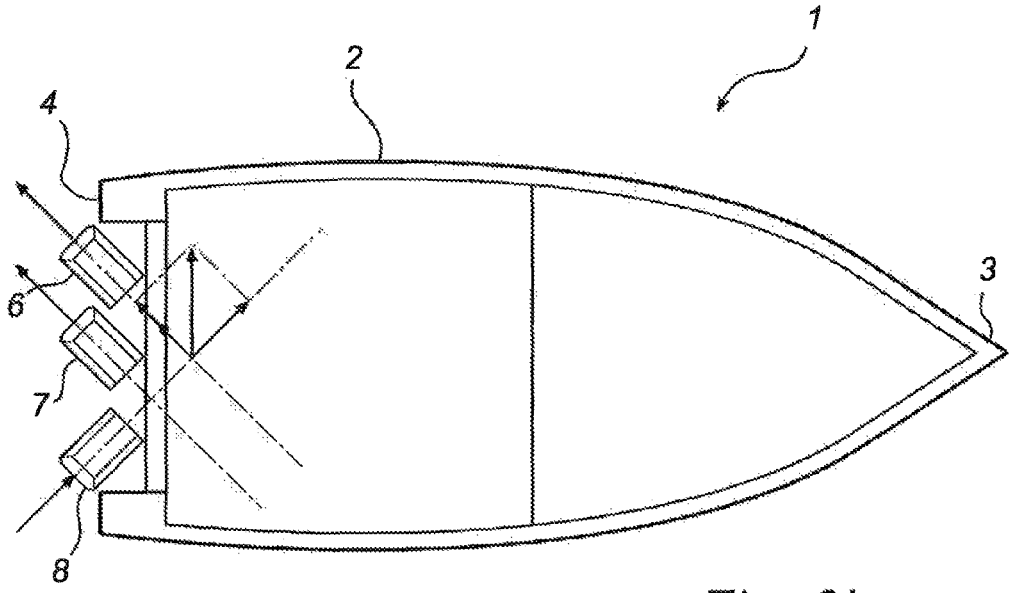

FIG. 3*a* and FIG. 3*b* illustrates two opposing sway movements, where the set of propulsion units in FIG. 3*a* are controlled by the control unit 10 to achieve a port sway movement and in FIG. 3*b* to perform a port sway movement. In one embodiment, an operator has tilted the joystick 14 to the starboard/port and thereby generated an input command to the control unit 10.

In both FIG. 3*a* and FIG. 3*b* the second propulsion unit 7 has a reverse gear selection, thus assisting the third 8 or first 6 propulsion unit with the reverse thrust respectively. As earlier discussed, the second 7 propulsion unit will always assist the propulsion unit 6, 8 that has a reverse gear selection, since the propulsion unit with reverse gear selection has the most tendency for cavitation effect.

Each of the propulsion units' thrust can be divided into force components in a forward/backward and port/starboard direction respectively. In both FIG. 3*a* and FIG. 3*b* the force component in the forward backward direction becomes zero, thus the vessel 1 will not surge either forwardly or backwardly. In FIG. 3*a* the force component in the port/starboard direction is directed to the starboard direction, thus the vessel will sway in a starboard direction. In FIG. 3*b* the force component in the port/starboard direction is directed to the port direction, thus the vessel will sway in a port direction.

Figure 4:
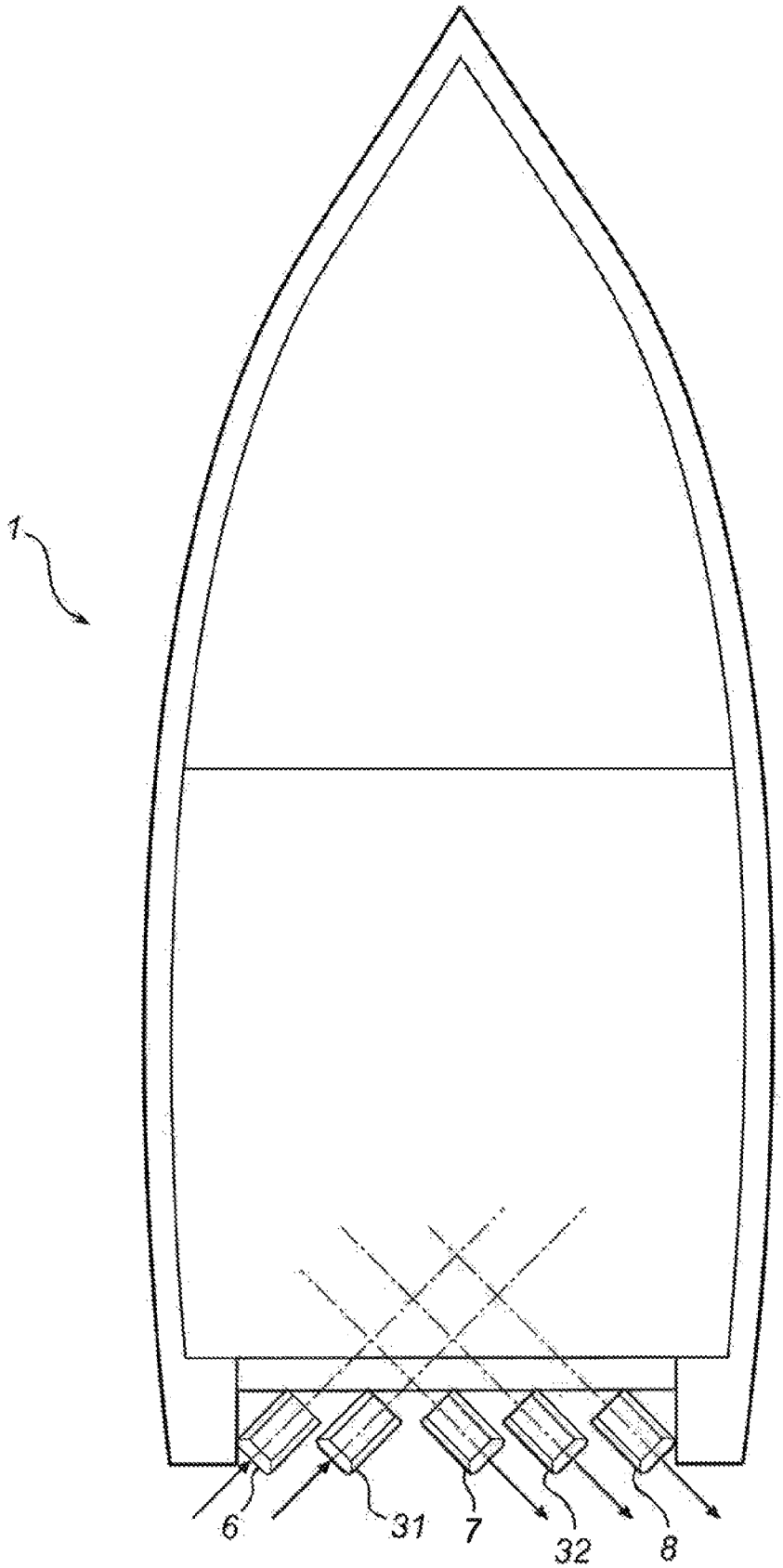

In FIG. 4 the exact same principal is illustrated, however the set of propulsion units in FIG. 4 comprise five propulsion units, more specifically a fourth 31 and fifth 32 propulsion units are introduced arranged between said first 6 and second 7 propulsion unit and between said second 7 and third 8 propulsion unit, respectively. Other than that, there are no differences from what is illustrated in and described to FIG. 3*a*. Thus, the vessel 1 shown in FIG. 4 will also sway in a starboard direction.

By assisting the propulsion unit with the reverse gear selected the vessel's 1 total thrust can be maximized through avoiding cavitation. The principle is illustrated in FIG. 5, which is a line chart showing the propulsion units' 6, 7, 8 rpm on the y-axis based on the amount the joystick 14 is tilted to the starboard side.

Figure 5:
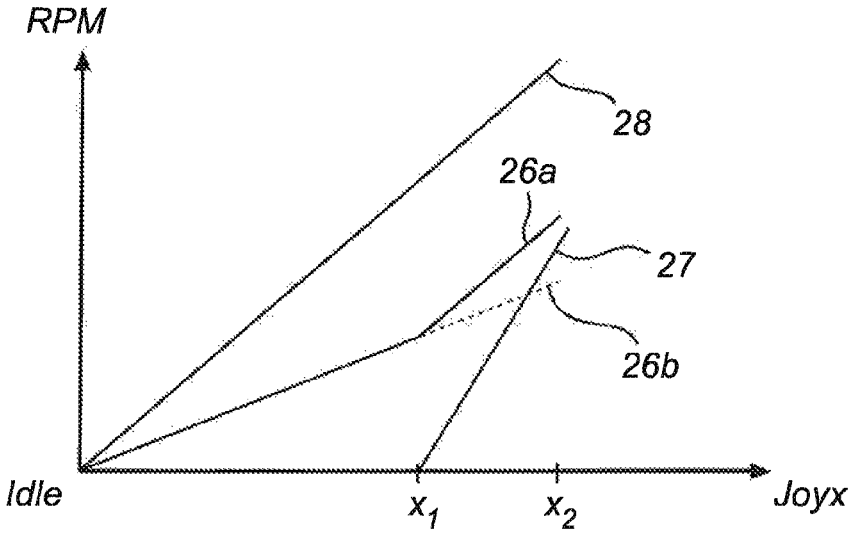
FIG. 5 is a line chart illustrating the thrust level of three propulsion units depending on an input command.

FIG. 5 is illustrating the scenario discussed in relation to FIG. 3*a*, when the vessel 1 makes a starboard sway movement. In the line chart's origin of coordinates the joystick 14 is in its neutral position, thus all propulsion units are idle. As the joystick 14 is tilted to the starboard, the RPM of the first 6 and third 8 propulsion units are increased as displayed with lines 26*a* and 28 respectively. The first propulsion unit 6 has a forward gear selection and the third propulsion unit has a backward gear selection. Since the forward gear selection is generally more efficient than a backward gear selection, the rpm of the first propulsion unit 6 does not have to be as high as for the third propulsion unit 8. As the joystick is tilted with an amount above X-i, the second 7 propulsion units goes from being idle to assisting the third propulsion unit 8 with the reverse thrust, as illustrated by line 27. By assisting the third propulsion unit 8, the rpm of the first propulsion unit 6 can be increased compared to if only the second propulsion unit 7 would have been idle, which is illustrated by the dotted line 26*b*. Moreover, at one point, indicated as X2 the third propulsion unit set with a reverse gear selection, will show tendency for cavitation. However, this point is further out on the x-axis, thus the total thrust of the vessel 1 is increased.

In measurements done by the inventor, the total thrust of the vessel 1 may possibly be increased with approximately 80-100 percent, depending on the type of engine and propeller used. Generally, the largest increases are with smaller engines, such as V6 engines compared to e.g. V8 engines. Moreover, the concept increases potential total thrust both in vessels 1 with outboard engines and inboard engines. The largest effect has however been measured in vessels with outboard engines, which typically use single propeller mountings, as opposed to inboard propulsion units that often use duoprop systems.

Figure 6:
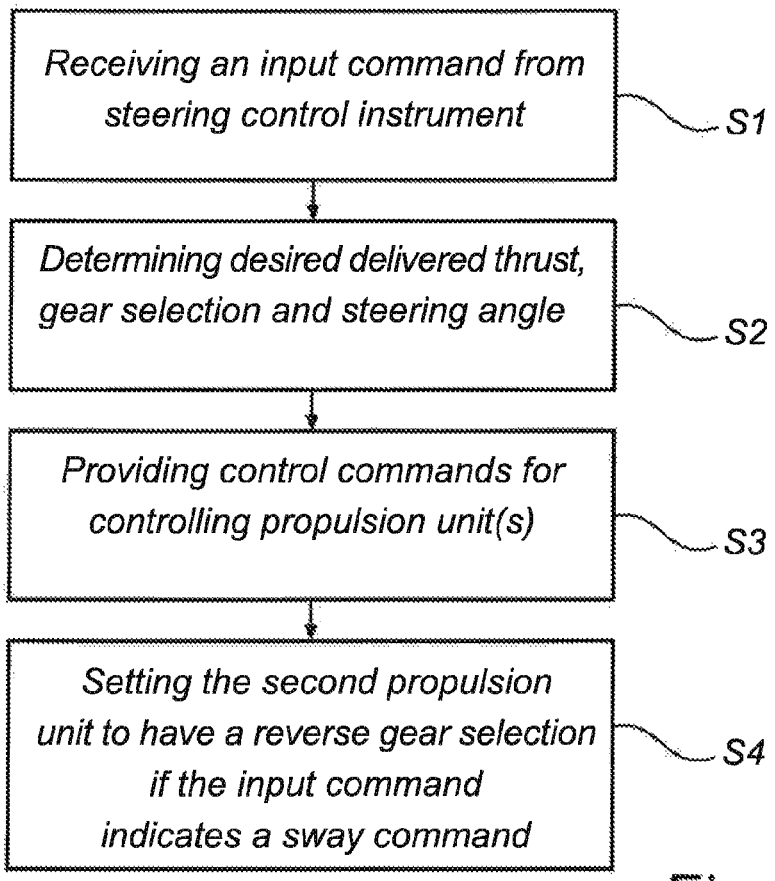
FIG. 6 is a flow-chart illustrating a method for controlling a set of propulsion units.

FIG. 6 is a block diagram showing the method for controlling the set of propulsion units 6, 7, 8 as described above wherein the method comprises receiving an input command S1 from a steering control instrument, such as the steering wheel 13, joystick 14 and/or thrust regulator 15 operating the vessel. Further the method comprises determining a desired delivered thrust, gear selection and steering angle S2 for the first 6, second 7 and third 8 propulsion unit respectively, based on the input command, and thirdly providing a set of control commands for controlling the desired delivered thrust, gear selection and steering angle S3 for the first 6, second 7 and third 8 propulsion unit. Further the method comprises setting the second propulsion unit 7 to have a reverse gear selection with a thrust level S4 if the input command indicates a sway command and the first propulsion unit is set to have a forward gear selection and the third propulsion unit is set to have a reverse gear selection, each with a thrust level, and if the thrust level for one of the first 6 or the third 8 propulsion unit exceeds a predetermined thrust level.

While the present invention has been described with reference to a number of preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed as the best mode contemplated for carrying out this invention, but that the invention will include all embodiments falling within the scope of the appended claims.

In the drawings and specification, there have been disclosed preferred embodiments and examples of the invention and, although specific terms are employed, they are used in a generic and descriptive sense only and not for the purpose of limitation, the scope of the invention being set forth in the following claims.

The invention claimed is:

1. A marine propulsion control system for controlling a set of propulsion units carried by a hull of a vessel, wherein the set of propulsion units comprise a first propulsion unit, a second propulsion unit and a third propulsion unit, wherein the second propulsion unit is provided as a center propulsion unit between the first and third propulsion unit, the marine propulsion control system comprising a control unit configured to:

receive an input command from a steering control instrument for operating the vessel;

determine a desired delivered thrust, gear selection and steering angle for the first, second and third propulsion unit respectively, based on the input command, and provide a set of control commands for controlling the desired delivered thrust, gear selection and steering angle for the first, second and third propulsion unit, wherein if the input command indicates a sway command the first propulsion unit is set to have a forward gear selection and the third propulsion unit is set to have a reverse gear selection, each with a selected thrust level, and only after the thrust level for at least one of the first and the third propulsion unit exceeds a predetermined thrust level the second propulsion unit is set to have a reverse gear selection with a thrust level depending on the selected thrust level of at least one of the first and the third propulsion unit.

2. The marine propulsion control system according to claim 1, wherein the first and third propulsion units' steering angles are substantially inverted relative a longitudinal axis.

3. The marine propulsion control system according to claim 1, wherein the second and third propulsion units' steering angles are substantially the same relative the longitudinal axis.

4. The marine propulsion control system according to claim 1, further comprising three independent Engine Control Unit (ECU) for providing an interface between the control unit and the first, second and third propulsion unit respectively.

5. The marine propulsion control system according to claim 4, wherein the three independent ECU are electrically connected to the control unit.

6. The marine propulsion control system according to claim 1, wherein the predetermined thrust level for one of the first or third propulsion unit corresponds to a level less than where a reverse propulsion direction of the first or third propulsion unit causes cavitation.

7. The marine propulsion control system according to claim 1, further comprising a steering control instrument for providing the control unit with an input command.

8. A marine vessel, comprising:

a first propulsion unit;

a second propulsion unit;

a third propulsion unit, wherein the second propulsion unit is provided as a center propulsion unit between the first and second propulsion unit, wherein each propulsion unit are carried by a hull, and a marine propulsion control system for controlling a set of propulsion units carried by a hull of a vessel, wherein the set of propulsion units comprises the first propulsion unit, the second propulsion unit and the third propulsion unit, the marine propulsion control system comprising a control unit configured to:

receive an input command from a steering control instrument for operating the vessel;

determine a desired delivered thrust, gear selection and steering angle for the first, second and third propulsion unit respectively, based on the input command, and provide a set of control commands for controlling the desired delivered thrust, gear selection and steering angle for the first, second and third propulsion unit, wherein if the input command indicates a sway command the first propulsion unit is set to have a forward gear selection and the third propulsion unit is set to have a reverse gear selection, each with a selected thrust level, and only after the thrust level for at least one of the first and the third propulsion unit exceeds a predetermined thrust level the second propulsion unit is set to have a reverse gear selection with a thrust level depending on the selected thrust level of at least one of the first and the third propulsion unit.

9. A method for controlling a set of propulsion units carried by a hull of a vessel, wherein the set of propulsion units comprise a first propulsion unit, a second propulsion unit and a third propulsion unit, wherein the second propulsion unit is provided as a center propulsion unit between the first and second propulsion unit, the method comprising:

receiving an input command from a steering control instrument operating the vessel;

determining a desired delivered thrust, gear selection and steering angle for the first, second and third propulsion unit respectively, based on the input command;

providing a set of control commands for controlling the desired delivered thrust, gear selection and steering angle for the first, second and third propulsion unit, and setting the second propulsion unit to have a reverse gear selection with a thrust level if the input command indicates a sway command and the first propulsion unit is set to have a forward gear selection and the third propulsion unit is set to have a reverse gear selection, each with a thrust level, and only after the thrust level for one of the first or the third propulsion unit exceeds a predetermined thrust level.

10. The method for controlling a set of propulsion units according to claim 9, further comprising:

providing the predetermined thrust level for one of the first or the third propulsion unit so that it corresponds to a level less than where a reverse propulsion direction of the first or third propulsion unit causes cavitation.

11. A computer program product comprising a non-transitory computer readable medium having stored thereon computer program means for causing a control unit to control a set of propulsion units carried by a hull of a vessel, wherein the set of propulsion units comprise a first propulsion unit, a second propulsion unit and a third propulsion unit, wherein the second propulsion unit is provided as a center propulsion unit between the first and second propulsion unit, wherein the computer program product comprises:

code for receiving an input command from a steering control instrument operating the vessel;

code for determining a desired delivered thrust, gear selection and steering angle for the first, second and third propulsion unit respectively, based on the input command;

code for providing a set of control commands for controlling the desired delivered thrust, gear selection and steering angle for the first, second and third propulsion unit, and code for setting the second propulsion unit to have a reverse gear selection with a thrust level if the input command indicates a sway command and the first propulsion unit is set to have a forward gear selection and the third propulsion unit is set to have a reverse gear selection, each with a thrust level, and only after the thrust level for one of the first or the third propulsion unit exceeds a predetermined thrust level.

* * * * *